US005549403A

United States Patent [19]

O'Shell

[11] Patent Number: 5,549,403

[45] Date of Patent: Aug. 27, 1996

[54] MULTI-ELEMENT WRITING INSTRUMENT

[76] Inventor: Michael V. O'Shell, 2311 Mechanic, No. 201, Galveston, Tex. 77550

[21] Appl. No.: 152,968

[22] Filed: Nov. 15, 1993

Related U.S. Application Data

[63] Continuation of Ser. No. 977,543, Nov. 17, 1992, abandoned.

[51] Int. Cl.[6] ..... B43K 27/00; B43K 27/08

[52] U.S. Cl. ..... 401/31; 401/29

[58] Field of Search ..... 401/29, 31, 30, 401/32, 33, 107, 108

[56] References Cited

U.S. PATENT DOCUMENTS

| | | | |
|---|---|---|---|
| 2,149,705 | 3/1939 | Maucher | 401/31 |
| 2,468,258 | 4/1949 | Fahringer et al. . | |
| 3,103,205 | 9/1963 | Legnant . | |
| 3,130,712 | 4/1964 | Kahn et al. | 401/35 |
| 3,262,427 | 7/1966 | Von Arx | 401/31 |
| 4,692,046 | 9/1987 | Lan | 401/32 |

FOREIGN PATENT DOCUMENTS

| | | | |
|---|---|---|---|
| 949815 | 9/1949 | France | 401/31 |
| 1011368 | 6/1952 | France | 401/31 |
| 1307761 | 9/1962 | France . | |
| 1424491 | 12/1965 | France | 401/107 |
| 881015 | 7/1949 | Germany | 401/32 |
| 4020209 | 6/1991 | Germany | 401/30 |
| 678251 | 12/1964 | Italy | 401/31 |
| 259146 | 1/1949 | Switzerland | 401/31 |
| 581030 | 10/1976 | Switzerland | 401/107 |

*Primary Examiner*—Steven A. Bratlie
*Attorney, Agent, or Firm*—Hitt Chwang & Gaines, P.C.

[57] ABSTRACT

A multi-element writing instrument adapted for use with wicking-type writing elements to operate as a multi-element, multi-color felt tip highlighting pen is disclosed. The instrument comprises 1) an elongated body, the body terminating with an opening and containing first and second separate lengthwise chambers therein, the first and second chambers containing first and second writing wicks, respectively, the wicks alternatively selectably extendable through the opening and 2) a structure for preventing fluids within the first and second wicks from commingling. In a preferred embodiment, the instrument provides a protrusion, mounted on the wicks proximate the writing ends, which prevents inks within the wicks from commingling by preventing the wicks from coming into contact with each other or with the body of the instrument.

36 Claims, 1 Drawing Sheet

MULTI-ELEMENT WRITING INSTRUMENT

This is a continuation, of application Ser. No. 07/977, 543, filed Nov. 17, 1992 now abandoned.

TECHNICAL FIELD OF THE INVENTION

The present invention is directed to a multi-element writing instrument and, more specifically, to such an instrument adapted for use with wicking-type writing elements to operate as a multi-element felt tip highlighting pen.

BACKGROUND OF THE INVENTION

Multi-element pens, in the general sense, are not new. Many a school child has found fascination in multi-colored ball point pens, which give them a capacity to express themselves with a new-found versatility and artistic flair in their writings and drawings. Ball point pens also serve the cause of neatness in that they encapsulate their ink reservoirs within cartridges comprising a hard plastic or metal element case and a cap over the end of the case having a tight-fitting ball point writing end. Ink cannot leak from the cartridge unless the ball is rolling along a surface, preferably a suitable writing surface. To accommodate the needs of those seeking colorful expression and cleanliness in the form of multi-element ball point pens, the prior art has responded by providing a plethora of alternative structures for such pens.

For instance, French Patent no. 1,307,761, which issued on Sep. 17, 1962 to Dutoit, is directed to a multi-element pen having a plurality of ball point cartridges therein, presumably giving the pen the ability to accommodate multiple colors, and a mechanism for selectively extending one of the pen cartridges to thereby allow the pen to write in a selected color.

Another such pen is described in U.S. Pat. No. 2,468,258, which issued on Apr. 26, 1949, to Fahringer et al., and which is directed to plotting instruments of the type known as ball point pens. Specifically, Fahringer et al. provide a structure which allows removal and replacement of individual ball point pen cartridges, allowing the pen to be reloaded as individual cartridges become spent. Fahringer et al. also teach that any ball point pen cartridge may be replaced by a cartridge containing pencil lead to enable the pen to also selectively function as a pencil.

In yet another example, U.S. Pat. No. 3,103,205, which issued on Sep. 10, 1963 to Lagnani, is directed to a multiple-element and of a type similar to that disclosed in Fahringer et al., above. Namely, Lagnani provides for a pen body capable of receiving ball point cartridges which can be reloaded should an individual cartridge become empty.

Unfortunately, school children grow older; and as they progress into high school, college and career, their needs for writing instruments change. Instead of ball point pens, many adults prefer the advantages provided by felt tip pens, wherein wicking-type elements are employed within the pens to hold ink within a fibrous matrix. In contrast with ball point pens, felt tip pens provide a capacity to express one's self in bolder, more colorful strokes, but nonetheless allow the same degree of control over placement of those strokes. This is due to provision of a relatively small writing point on the end of the wick which has an accuracy of delivery similar to ball points. Of course, such writing points can be made of almost any size to produce lines widths from the very fine to the very broad. Although felt tip pens are more prone to accidental leakage caused by unintentional contact of the writing point with another object, adults tend to take greater care in handling pens than do children.

Another favorite writing tool for those adults is the highlighter, a phenomenon which has arisen in the past two decades to revolutionize the process of emphasizing text. Before highlighters, one wishing to emphasize text would underscore the text with colored ink delivered from a standard ball point or felt tip pen. One could not, however, score through the text, because the ink would cover up the text, lessening its readability. Highlighters, like other types of felt-tipped pens, come in a variety of colors, allowing one to highlight text in many different colors representing a code used by the reader, each color signifying a different category or purpose, or perhaps only for aesthetic effect.

A highlighter employs a relatively large writing point in conjunction with a translucent ink to allow one to deposit the ink on a writing surface, the ink allowing previously written underlying text to remain readable. However, addition of the translucent ink calls attention to that underlying text. Highlighters share the disadvantages of other wicking-type pens in that they employ a fibrous wick which can leak.

Traditionally, both felt tip and highlighter pens have been provided only as single element pens. In the past, should a reader desire multiple highlighter colors, he had to purchase a plurality of separate, single-element highlighter pens and manage each of them separately, replacing caps and trading pens whenever necessary. Thus, one wishing to write or highlight in multiple colors had to deal with a separate pen for each color, unable to enjoy the advantages a single multi-element pen brings.

All of the devices described above are directed to multi-element ball point pens or pencils. What the prior art fails to teach is provision of a multi-element writing instrument which has been specially adapted to handle wicking-type writing elements (either felt tip or highlighter).

Because the structures previously discussed had only to accommodate ball point elements or pencil leads, they did not have to deal with the unique problems encountered when working with wicking-type elements. First, the prior art employed devices for axially displacing a particular selected element into a writing position and retracting the selected element from the writing position to a retracted position within the pen. To accomplish this displacement, the devices were located at an end of the pen distal from a writing end to force the elements, against a spring force, downward and through an opening in the writing end of the pen.

During writing, pressure applied to the writing end of the element as it wrote had to be transmitted up the element and to the device. Unfortunately, wicking elements do not have a hard plastic or metal element case by which to transmit this force. Wicking elements comprise a fibrous material within which ink is stored in a capillary fashion. Therefore, such wicking elements are not suited to receive longitudinal pressure; they simply bend or compress, frequently unleashing their ink in the process. Accordingly, the prior art provided single-element wicking pens having a structure which holds the wick at the bottom, close to the writing end, allowing the remainder of the wick to reside within the pen body without forces thereon. This arrangement is not suitable in the environment of multi-element pens, where such a structure would be too large and complex to place at the writing end of the pen.

Secondly, ball point pens are capsules. That is, they 1) form a reservoir within the element body for holding the ink and 2) cap that reservoir with a rolling ball element which, when not rolling, keeps ink from flowing from within the pen. Therefore, it is easier to control the dispensing of ink from a ball point pen than it is from a felt tip pen or highlighter.

Multi-element highlighter pens or, in general, multi-element felt tip pens were simply not available in the prior art. This was so because the prior art had not devised a way to deal successfully with the ink control and "flimsy wick" aspects of felt tip elements. Therefore, the prior art has utterly failed in its attempts to provide a multi-element felt tip pen, especially of the highlighter variety, which combines the advantages of multi-element ball point pens with those of felt tip or highlighter pens.

SUMMARY OF THE INVENTION

It is therefore a primary object of the present invention to provide a multi-element writing instrument comprising (1) an elongated body, the body terminating with an opening and containing first and second separate lengthwise chambers therein, (2) first and second writing wicks located within the first and second chambers, respectively, the wick selectably extendable through the opening and (3) a structure for preventing fluids within the first and second wicks from commingling.

It is a further object of the present invention to provide an instrument wherein a first wick has a writing end, the writing end extending through an opening when the first wick is extended, a structure for preventing commingling mounted on the first wick proximate the writing end to thereby prevent fluid within the first wick from commingling with other fluid by coming into contact with the pen body.

Another object of the present invention is to provide an instrument further comprising a tapered portion located between a body and an opening.

Still another object of the present invention is to provide an instrument wherein first and second chambers merge into a single chamber within a tapered portion.

Still a further object of the present invention is to provide an instrument further comprising a structure for preventing fluids within first and second wicks from contacting a tapered portion and an opening.

Yet a further object of the present invention is to provide an instrument further comprising first and second means for alternatively extending first and second wicks, respectively, through an opening.

And another object of the present invention is to provide an instrument further comprising first and second means for alternatively maintaining first and second wicks, respectively, in an extended position through an opening.

Yet a further object of the present invention is to provide an instrument further comprising first and second means for retracting first and second wicks, respectively, into a storing position within first and second chambers, respectively.

Another object of the present invention is to provide an instrument wherein first and second wicks are surrounded lengthwise by first and second sheaths, respectively, the first and second sheaths transmitting forces exerted along lengths of the first and second wicks, respectively.

A further object of the present invention is to provide an instrument wherein first and second sheaths are liquid impermeable.

A further object of the present invention is to provide an instrument wherein fluids are composed of a dye.

Still a further object of the present invention is to provide an instrument wherein first and second wicks are constructed of a fibrous substance.

Yet another object of the present invention is to provide an instrument wherein an opening is covered by a pen cap during periods of non-use.

Another primary object of the present invention is to provide a method of using a multi-element writing instrument comprising the steps of (1) removing a pen cap from an opening in an elongated pen body, the body containing first and second separate lengthwise chambers therein and (2) extending a selectable one of first and second writing wicks located within the first and second chambers, respectively, through the opening, the pen including means for preventing fluids within the first and second wicks from commingling.

Still a further primary object of the present invention is to provide a sheathing structure for use in conjunction with a writing instrument comprising: (1) a sheath covering a writing wick except for a writing end of the wick, the wick located within a multi-element writing instrument and (2) means for preventing comingling of inks between the wick and other wicks within the instrument, the preventing means coupled to the wick. The preventing means comprises a protrusion about the wick proximate the writing end. The protrusion comes in contact with an interior surface of a tapered end of a body of the instrument to thereby prevent the writing end from contacting the surface when the wick is extended.

In the attainment of the foregoing objects, the preferred embodiment of the present invention is a multi-element pen comprising: (1) an elongated pen body having a tapered end, the tapered end terminating in an opening, (2) a partition within the elongated body, the partition dividing an interior of the body into two elongated wick chambers, the partition extending a length of the body and terminating at the tapered end, the wick chambers opening into a single chamber located within the tapered portion, (3) ink-containing wicks having writing ends located in the wick chambers, the wicks alternatively axially displaceable into the single chamber, the writing ends extending through the opening to thereby enable the writing ends to deliver ink outside the pen, and (4) a sheathing structure covering each of the wicks except for the writing ends, the structure preventing the writing ends from coming in contact with the single chamber and the opening to thereby prevent commingling of inks between the wicks, the structure further allowing transmission of force along lengths of the wicks.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
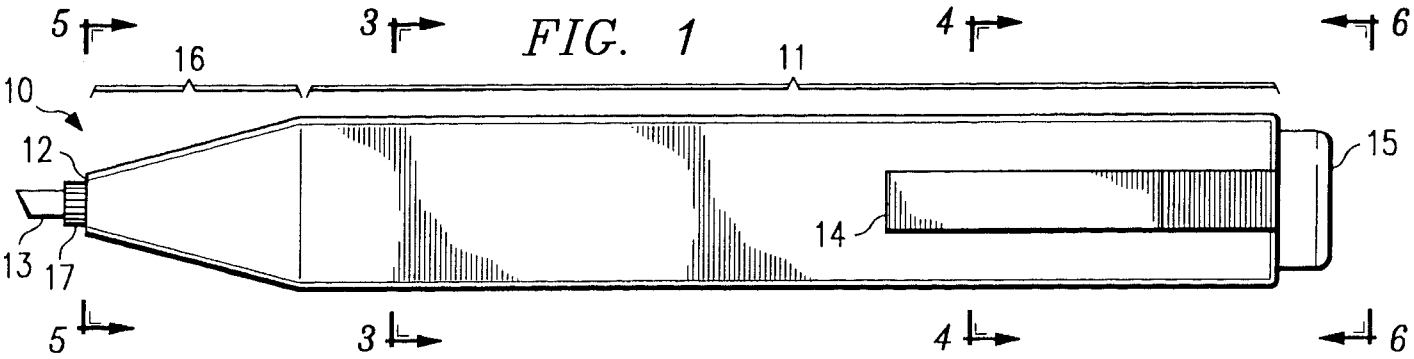
FIG. 1 is a longitudinal elevation view of the multi-element pen of the present invention.

Turning now to FIG. 1, shown is a longitudinal elevational view of the multi-element writing instrument of the present invention. The instrument, generally designated 10, comprises an elongated pen body 11 having a tapered end 16 and an opening 12 therein. As shown in FIG. 1, one writing end 13 is in an extended position. The writing end 13 has a protrusion 17 which holds the writing end 13 securely within the opening 12. Also shown in FIG. 1 are a pen clip 14 and a top 15, which seals a top end of the instrument 10.

Figure 2:
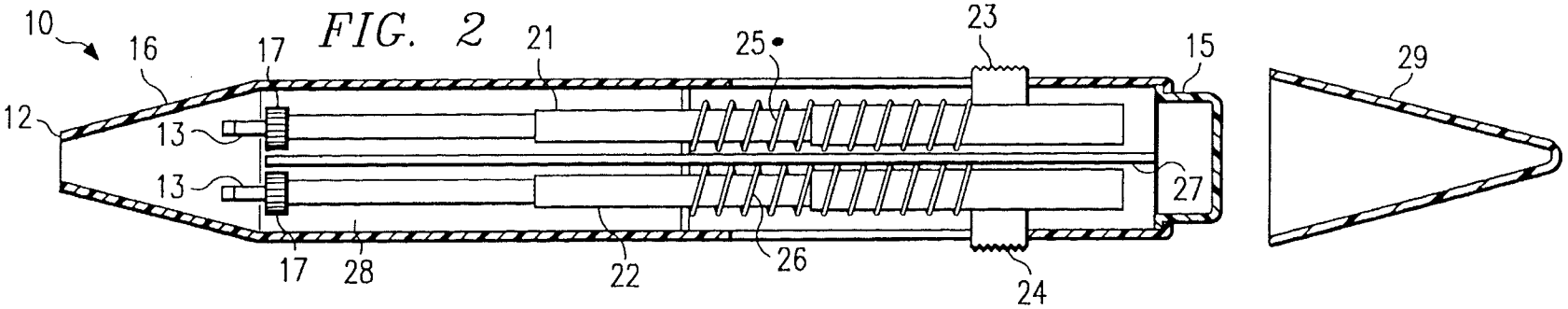
FIG. 2 is a longitudinal sectional view of the multi-element pen of the present invention.

Turning now to FIG. 2, shown as a longitudinal sectional view of the multi-element writing instrument of the present invention. The instrument 10 is shown as comprising a first writing element 21, a second writing element 22, a first means for extending, maintaining and retracting the first element 21, a second means for extending, maintaining and retracting the second element 24, and first spring 25, a second spring 26, a dividing wall or partition 27 and a chamber 28, defined by the presence of the partition 27. Also shown is a pen cap 29, which is adapted to be engaged with and cover an exterior surface of the tapered portion 16, thereby covering the opening 12 when the instrument 10 is not in use, or engaged with and cover an exterior surface of the top 15 in a storage position when the instrument 10 is in use.

It is particularly important to note in FIG. 2 that the protrusions 17 have a diameter greater than the first and second elements 21, 22. When the first and second elements 21, 22 are selectively axially displaced so that a selectable one of the first and second elements 21, 22 advances such that the writing end 13 of one of the first and second elements 21, 22 advances through the opening 12, the protrusion 17 is great enough in diameter such that the writing end 13 does not come in contact with an interior surface of the tapered portion 16. Instead, the interior surface of the tapered portion 16 forces the protrusion 17 toward a centerline of the instrument 10, causing a bending inward of the selected element 21, 22 to thereby guide the element toward the opening 12. This is apparent as shown in FIG. 2.

As the selected element continues its axial displacement toward the opening, the selected element becomes centered on the opening 12, allowing the writing end 13 to pass through and the protrusion 17 to engage and occupy the opening 12. It is a key feature of the present invention that the writing end 13 does not contact the interior of the instrument 10 (including the tapered portion 16 and the opening 12) so as to preserve the integrity of the shape of the writing ends of the elements 21, 22 and especially so that various inks within the writing elements 21, 22, which preferably are of different colors, are not allowed to contact common surfaces, thereby commingling the inks, producing an undesirable combination of colors within the elements 21, 22, thereby ruining the pen.

The elements 21, 22 are further provided with sheaths (shown, but not referenced) which surround the elements 21, 22 and performing two vital functions. First, the sheaths keep inks, which are within the elements 21, 22, from escaping from within. Second, the sheaths allow forces developed by the first and second means for extending, maintaining and retracting the first and second elements 23, 24 to transmit force longitudinally down each of the elements 21, 22 during operation of the pen. The ability of the sheaths to transmit force is particularly helpful when the instrument 10 is in use. When pressure or force is applied to the writing end 13, it is strongly desired that the elements 21, 22 not bend or otherwise compress longitudinally. The sheaths provide substantial stiffness to the first and second elements 21, 22 so that the fibrous wicking material constituting the first and second elements 21, 22 do not have to transmit the force.

Figure 3:
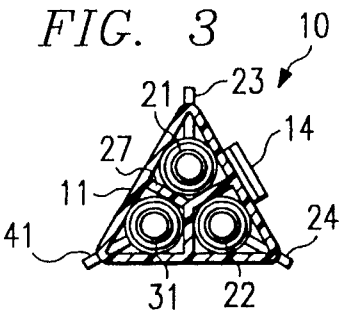
FIG. 3 is an endwise sectional view of the multi-element writing instrument of the present invention taken along Section 3—3 of FIG. 1.

Turning now to FIG. 3, shown is an endwise sectional view of the multi-element writing instrument of the present invention, taken along Section 3—3 of FIG. 1. Note in particular how the partition 27 creates three chambers within the pen body 11, keeping the elements 21, 22 and a third element 31, from contacting each other, thereby eliminating the possibility of trading or commingling inks between the various elements 21, 22, 31. In the preferred embodiment of the present invention, the partition divides the instrument 10 into three chambers, as shown. Furthermore, the preferred embodiment provides for an instrument having a triangular cross-section, as shown. The triangular cross-section aids the user in manually gripping the instrument 10 to better enable its use.

Figure 4:
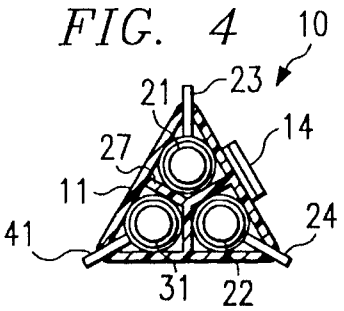
FIG. 4 is an endwise sectional view of the multi-element writing instrument of the present invention taken along Section 4—4 of FIG. 1.

Turning now to FIG. 4, shown as an endwise sectional view of the multi-element writing instrument of the present invention, taken along Section 4—4 of FIG. 1. FIG. 4 is presented primarily for the purpose of showing the interaction of the means 23, 24, 41 for extending, maintaining and retracting the various elements 21, 22, 31. The means 23, 24, 41 comprise axially slideable members having treads or knurls (not referenced, but shown in FIG. 2) thereon to allow the user to grip and axially displace a selectable one of the means against the force of corresponding springs 25, 26 of FIG. 2. The means 23, 24, 41 reach through the pen body 11 to the first, second and third elements 21, 22, 31, respectively, to impart force to a selected corresponding element 21, 22, 31, thereby axially displacing the selected element.

Figure 5:
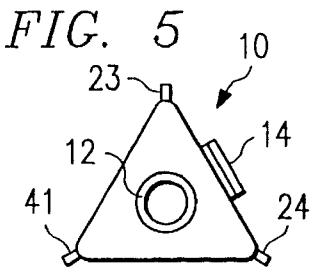
FIG. 5 is a front elevational view of the multi-element writing instrument of the present invention.

Turning now to FIG. 5, shown is a front elevational view of the multi-element writing instrument of the present invention. FIG. 4 is presented to show the location of the opening 12 with respect to the instrument 10. Note when comparing FIGS. 4 and 5 that the elements 21, 22, 31 must, in fact, bend inward to extend their corresponding writing ends 13 and protrusions 17 through the opening 12. Again, the function of the protrusions 17 is to prevent the writing end 13 of the various elements 21, 22, 31 from contacting the interior surface of the tapered portion 16 of FIG. 1 and the opening 12 as the elements 21, 22, 31 are extended and bent inward by action of the interior surface of the tapered portion.

Figure 6:
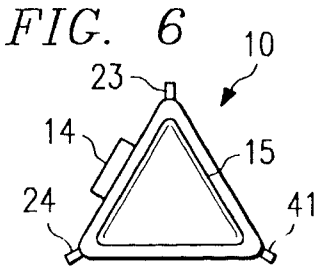
FIG. 6 is a rear elevational view of the multi-element writing instrument of the present invention.

Turning now to FIG. 6, shown is a rear elevational view of the multi-element writing instrument of the present invention. FIG. 6 is presented to show the relationship of the top 15 to the instrument 10, and to show that the pen cap 29 of FIG. 2 is adapted to cover the external surface of the top 15 during times of instrument use.

The preferred materials for constructing the instrument 10 are conventional. For instance, the instrument 10 is preferably constructed of plastic, except for the springs 25, 26, which are preferably constructed of a resilient metal. The elements 21, 22, 31 are constructed of the same porous, fibrous material used in conventional felt tip pens and highlighters and are sheathed in a somewhat flexible plastic. It is important that the sheaths be thick enough to transmit force without bending, but be thin enough to accommodate the minimal inward bending required when extending an element to use it for writing. Likewise, the protrusion 17 is preferably made of the same plastic as the sheaths and is integral therewith. However, the protrusion 17 may be made of another material, does not have to be integral with the sheath and need not be of the geometry or size as shown in FIG. 2. The protrusion 17 need only perform the function of keeping the inks from commingling.

The preferred embodiment of the multi-element writing instrument is as a multi-colored highlighter, employing slanted-surface writing ends to thereby allow the instrument to create highlights of different widths. However, it is apparent that the instrument could contain inks of the same color, with writing ends of different geometry and could contain opaque inks, of the type found in laundry or other permanent markers.

From the foregoing, it is apparent that the present invention is the first to provide a multi-element writing instrument comprising (1) an elongated body, the body terminating with an opening and containing first and second separate lengthwise chambers therein, (2) first and second writing wicks located within the first and second chambers, respectively, the wicks selectably extendable through the opening and (3) a structure for preventing fluids within the first and second wicks from commingling.

Although the present invention and its advantages have been described in detail, it should be understood that various changes, substitutions and alterations can be made herein without departing from the spirit and scope of the invention as defined by the appended claims.

What is claimed is:

1. A multi-element writing instrument, comprising:

an elongated body, said body terminating with a single opening and containing first and second separate lengthwise chambers therein;

first and second writing wicks located within said first and second chambers, respectively, said wicks alternatively selectably extendable through said single opening, said wicks each forming a portion of a felt-tip writing element; and means for preventing fluids within said first and second wicks from commingling, said means for preventing including a protrusion about each of said wicks, said protrusion having a diameter sufficient to prevent said wicks from contacting an inner surface of said elongated body proximate said single opening.

2. The instrument as recited in claim 1 wherein said first wick has a writing end, said writing end extending through said opening when said first wick is extended, said preventing means mounted on said first wick proximate said writing end to thereby prevent fluid within said first wick from commingling with other fluids by coming into contact with said pen body.

3. The instrument as recited in claim 1 further comprising a tapered portion located between said body and said opening.

4. The instrument as recited in claim 3 wherein said first and second chambers merge into a single chamber within said tapered portion.

5. The instrument as recited in claim 4 further comprising means for preventing said fluids within said first and second wicks from contacting said tapered portion and said opening.

6. The instrument as recited in claim 1 further comprising first and second means for alternatively extending said first and second wicks, respectively, through said opening.

7. The instrument as recited in claim 1 further comprising first and second means for alternatively maintaining said first and second wicks, respectively, in an extended position through said opening.

8. The instrument as recited in claim 1 further comprising first and second means for retracting said first and second wicks, respectively, into a storing position within said first and second chambers, respectively.

9. The instrument as recited in claim 1 wherein said first and second wicks are surrounded lengthwise by first and second sheaths, respectively, said first and second sheaths transmitting forces exerted along lengths of said first and second wicks, respectively.

10. The instrument as recited in claim 9 wherein said first and second sheaths are liquid impermeable.

11. The instrument as recited in claim 1 wherein said fluids comprise a dye.

12. The instrument as recited in claim 1 wherein said first and second wicks are constructed of a fibrous substance.

13. The instrument as recited in claim 1 wherein said opening is covered by a pen cap during periods of non-use.

14. A method of using a multi-element writing instrument, comprising the steps of:

removing a pen cap from a single opening in an elongated pen body, said elongated body containing first and second separate lengthwise chambers therein; and extending an alternatively selectable one of first and second writing wicks located within said first and second chambers, respectively, through said single opening, said wicks each forming a portion of a felt-tip writing element, said pen including means for preventing fluids within said first and second wicks from commingling, said means for preventing including a protrusion about each of said wicks, said protrusion having a diameter sufficient to prevent said wicks from contacting an inner surface of said elongated body proximate said single opening.

15. The method as recited in claim 14 wherein said first wick has a writing end, said writing end extending through said opening when said first wick is extended, said preventing means mounted on said first wick proximate said writing end to thereby prevent fluid within said first wick from commingling with other fluid by coming into contact with said pen body.

16. The method as recited in claim 14 wherein said pen body further comprises a tapered portion located between said body and said opening.

17. The method as recited in claim 16 wherein said first and second chambers merge into a single chamber within said tapered portion.

18. The method as recited in claim 16 wherein said pen further comprises means for preventing said fluids within said first and second wicks from contacting said tapered portion and said opening.

19. The method as recited in claim 14 wherein said pen further comprises first and second means for alternatively maintaining said first and second wicks, respectively, in an extended position through said opening.

20. The method as recited in claim 14 wherein said pen further comprises first and second means for retracting said first and second wicks, respectively, into a storing position within said first and second chambers, respectively.

21. The method as recited in claim 14 wherein said first and second wicks are surrounded lengthwise by first and second sheaths, respectively, said first and second sheaths transmitting forces exerted along lengths of said first and second wicks, respectively.

22. The method as recited in claim 21 wherein said first and second sheaths are liquid impermeable.

23. The method as recited in claim 14 wherein said fluids comprise a dye.

24. The method as recited in claim 14 wherein said first and second wicks are constructed of a fibrous substance.

25. The method as recited in claim 14 wherein said opening is covered by said pen cap during periods of non-use.

26. A multi-element pen, comprising:

an elongated pen body having a tapered end, said tapered end terminating in a single opening;

a partition within said elongated body, said partition dividing an interior of said elongated body into two elongated wick chambers, said partition extending a length of said elongated body and terminating at said tapered end, said wick chambers opening into a single chamber located within said tapered end;

first and second ink-containing wicks having writing ends located in said wick chambers, said first and second wicks each forming a portion of a felt-tip writing element, said first and second wicks alternatively axially displaceable into said single chamber, said writing ends alternatively extending through said single opening to thereby enable said writing ends to deliver ink outside said pen; and a sheathing structure covering each of said first and second wicks except for said writing ends, said structure preventing said writing ends from coming in contact with said single chamber and said single opening to thereby prevent commingling of inks between said first and second wicks, said structure including a protrusion about each of said first and second wicks proximate said writing ends, said protrusion having a diameter sufficient to prevent said wicks from contacting an inner surface of said elongated body proximate said single opening, said structure further allowing transmission of force along lengths of said first and second wicks.

27. The instrument as recited in claim 26 further comprising first and second means for alternatively extending said first and second wicks, respectively, through said opening.

28. The instrument as recited in claim 26 further comprising first and second means for alternatively maintaining said first and second wicks, respectively, in an extended position through said opening.

29. The instrument as recited in claim 26 further comprising first and second means for retracting said first and second wicks, respectively, into a storing position within said first and second chambers, respectively.

30. The instrument as recited in claim 26 wherein said sheathing structure is liquid impermeable.

31. The instrument as recited in claim 26 wherein said first and second wicks are constructed of a fibrous substance.

32. The instrument as recited in claim 26 wherein said opening is covered by a pen cap during periods of non-use.

33. A sheathing structure for use in conjunction with a writing instrument, comprising:

a sheath covering a writing wick except for a writing end of said wick, said wick located within a multi-element writing instrument, said wick forming a portion of a felt-tip writing element; and means for preventing commingling of inks between said wick and other wicks within said instrument, said preventing means coupled to said wick and including a protrusion about said wick proximate a felt-tip writing end of said wick, said protrusion having a diameter sufficient to prevent said wick from contacting an inner surface of said instrument, said inner surface proximate a single opening in said instrument.

34. The structure as recited in claim 33 wherein said protrusion comes into contact with an interior surface of a tapered end of a body of said instrument to thereby prevent said writing end from contacting said surface when said wick is extended.

35. The structure as recited in claim 34 wherein said tapered end is located between said body and an opening through which said writing end protrudes when said wick is extended.

36. The structure as recited in claim 33 wherein said structure is liquid impermeable.

* * * * *